US007283427B1

(12) United States Patent
Stevens

(10) Patent No.: US 7,283,427 B1
(45) Date of Patent: Oct. 16, 2007

(54) MACHINE FOR WAKING A SLEEPER

(76) Inventor: James Thomas Stevens, 3813 Dobbin Rd., Springfield, TN (US) 37172

( * ) Notice: Subject to any disclaimer, the term of this patent is extended or adjusted under 35 U.S.C. 154(b) by 137 days.

(21) Appl. No.: 11/297,070

(22) Filed: Dec. 8, 2005

(51) Int. Cl.
*G08B 17/10* (2006.01)

(52) U.S. Cl. ..... 368/12; 340/628; 340/521

(58) Field of Classification Search ..... 368/12, 368/10, 23–74; 340/628, 521
See application file for complete search history.

(56) References Cited

U.S. PATENT DOCUMENTS

| | | | | |
|---|---|---|---|---|
| 256,265 | A | 4/1882 | Applegate | |
| 1,046,533 | A | 12/1912 | Zukor | |
| 2,190,533 | A | 2/1940 | MacPherson | |
| 4,265,403 | A | 5/1981 | Bonetti | |
| 4,407,585 | A | 10/1983 | Hartford et al. | |
| 4,808,303 | A | 2/1989 | Edwards et al. | |
| 5,442,600 | A | 8/1995 | Kutosky | |
| 5,917,420 | A | 6/1999 | Gonzalez | |
| 5,966,346 | A | 10/1999 | Arai | |
| 6,544,971 | B1 | 4/2003 | Berliner et al. | |
| 7,129,833 | B2 * | 10/2006 | Albert | 340/521 |
| 7,170,404 | B2 * | 1/2007 | Albert et al. | 340/521 |
| 2006/0250260 | A1 * | 11/2006 | Albert et al. | 340/628 |

* cited by examiner

*Primary Examiner*—Gary F. Paumen
(74) *Attorney, Agent, or Firm*—David Douglas Winters

(57) ABSTRACT

Machine for waking a sleeper with water reservoir, water movement means, water lines, water outlet port, and timer/activation device.

10 Claims, 2 Drawing Sheets

MACHINE FOR WAKING A SLEEPER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of alarm devices and more specifically to machine for waking a sleeper.

It has long been realized that timely awakening from sleep and subsequent arising is propitious in that it accrues benefits to individuals as well as society as a whole. It has further been generally known that arousal from sleep upon the occurrence of such events as fire or entry into the house by a burglar may be similarly beneficial if not life saving. Therefore, many devices to awaken sleepers at predetermined times of necessity and upon the occurrence of calamitous events have been devised. Accordingly, the instant disclosure teaches an advancement of the art.

U.S. Pat. No. 4,407,585 by Hartford et al discloses an alarm device that awakens a sleeper by stimulating his sense of smell by delivering into his immediate environment a vaporous, aromatic element of sufficient pungency to cause awakening.

In substantial contrast to Hartford, the instant art teaches awakening a sleeper by delivery to the body of the sleeper of water in a liquid, not vaporous, not aromatic, state so that his sense of touch and his ability to sense cold are exploited to cause an awakening stimulus.

U.S. Pat. No. 6,544,971 B1 by Berliner et al. recites a method of increasing alertness in an individual by administering a vomeropherine, a drug, to a sleeping individual.

In substantial contrast to Berliner et al, the instant art teaches arousal of a sleeper by stimulation of his tactile senses rather than by introducing foreign chemicals into the metabolic system causing metabolic or physiological changes in his brain, limbic system, or other bodily structures the vomeropherine might affect.

U.S. Pat. No. 5,966,346 by Arai discloses an alarm device to awaken a sleeper by means of sound.

In contrast to Arai, the instant art recites awakening a sleeper by means of substantially silent water spray.

U.S. Pat. No. 5,442,600 by Kutosky teaches an electronic digital audio alarm clock device with a snooze option which will deliver an audio alarm to a sleeper at a predetermined time or times.

In contrast to the instant art, Kutosky does not teach a method to affect a tactile alarm for a sleeper, but may be limited in effectiveness by employing only an audio signal. Overcoming such a limitation is one goal of the instant art.

U.S. Pat. No. 5,917,420 by Gonzalez teaches an alarm apparatus for shaking a piece of furniture in response to detection of a physical occurrence. Thus, Gonzalez discloses means to create reciprocal motion by means of cams with the reciprocal motion imparted ultimately to a piece of furniture.

In contrast to Gonzalez, the instant art teaches awakening a sleeper by means of a water spray and thus comprises no means to create a force that would cause a piece of furniture to move.

U.S. Pat. No. 4,265,403 by Bonetti teaches a complex lawn sprinkler water delivery system to dispense large quantities of water at predetermined times over a large area comprising a plurality of sprinkler heads connected in a series, a plurality of timing valves, water operated motors, and manually adjustable control setting devices for the sprinkler heads. In addition, Bonetti teaches complex pressure control means for water within the system and backflow prevention means.

In contrast to Bonetti, the instant disclosure teaches an alarm system using water delivery to a very limited area at predetermined times having no motorized sprinkler heads, no manually set control devices for the sprinkler heads, no plurality of individual timing valves for a plurality of sprinkler heads, and parallel connection of water outlet ports if there be more than one. Furthermore, the instant art requires no pressure regulation or backflow prevention means.

U.S. Pat. No. 4,808,303 by Edwards et al discloses a produce hydration system that will deliver only misted water to farm produce in display racks. The Edwards art comprises a filter unit and filter cleaning means, a pressurization system to ensure instant flow of water through the flow heads upon activation of the system, spray heads having non-adjustable restriction means to produce a fine mist, and drippage control means.

In contrast to Edwards et al, the instant art teaches an alarm system using water spray having no pressurizing system activated before opening of a valve to allow flow of water to a spray head and requiring no instantaneous flow of water upon activation of the system. In further contrast to Edwards et al, the instant disclosure teaches no filtration or filter cleaning means and no drippage control means. In yet further contrast to Edwards et al, the instant art recites adjustable spray head restriction means to produce a variable flow from a subtle spray to a full soaking flow but is not limited to the delivery of a mist.

U.S. Pat. No. 256,265 by Applegate discloses a device to awaken a sleeper at a specific time comprising a timer and means to drop solid material onto the head of the sleeper comprising suspension lines, pulleys, and a suspension line disengagement device.

In substantial contrast to Applegate, the instant art teaches awakening a sleeper only by spraying water on him/her and has no pulleys, suspension lines, or suspension line disengagement device. It requires no blows to the head by blunt instruments.

U.S. Pat. No. 2,190,533 by MacPherson teaches a means to awaken a sleeper by allowing solid material hingably connected to a wall to fall on him at a predetermined time. MacPherson further recites a suspension line, at least one pulley, and a hinged platform to support the awakening stimulus.

In substantial contrast to MacPherson, the instant art teaches awakening of a sleeper by means of spraying water rather than dropping a solid mass on his head and comprises no suspension lines, pulleys, or support platforms to affect the awakening stimulus.

U.S. Pat. No. 1,046,533 by Zukor discloses a device to waken a sleeper by spraying water on him upon the opening of a door or the raising of a window. Furthermore, Zukor teaches a complicated water delivery system having racks, pinions, and cams. Also, Zukor teaches activation of the system by means of mechanical energy provided by an intruder.

In contrast to Zukor, the instant art teaches a simple water delivery system having no racks, pinions, or cams. In additional contrast to Zukor, the instant art is activated by electronic signals from a timing device thus teaching away from activation by mechanical energy provided by another person. In further contrast to Zukor, the instant art teaches activation of the device at specific predetermined times and is not limited to activation upon an indefinite occurrence as taught by Zukor.

BRIEF SUMMARY OF THE INVENTION

The primary object of the invention is to awaken a sleeper by means of a light spray of water as a harmless, tactile stimulus.

Another object of the invention is to awaken a sleeper who may not respond to stimulation of his/her other senses, for example a hearing impaired person.

Still another object of the invention is to awaken a sleeper at a predetermined time or to activate the system at specific, predetermined intervals subsequent to a predetermined time.

Yet another object of the invention is to provide a device that is simple and economical to manufacture.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed machine for waking a sleeper comprising: water reservoir, pumping means, water lines, nozzle, and timer/activation device.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF COMPONENTS

Figure 1:
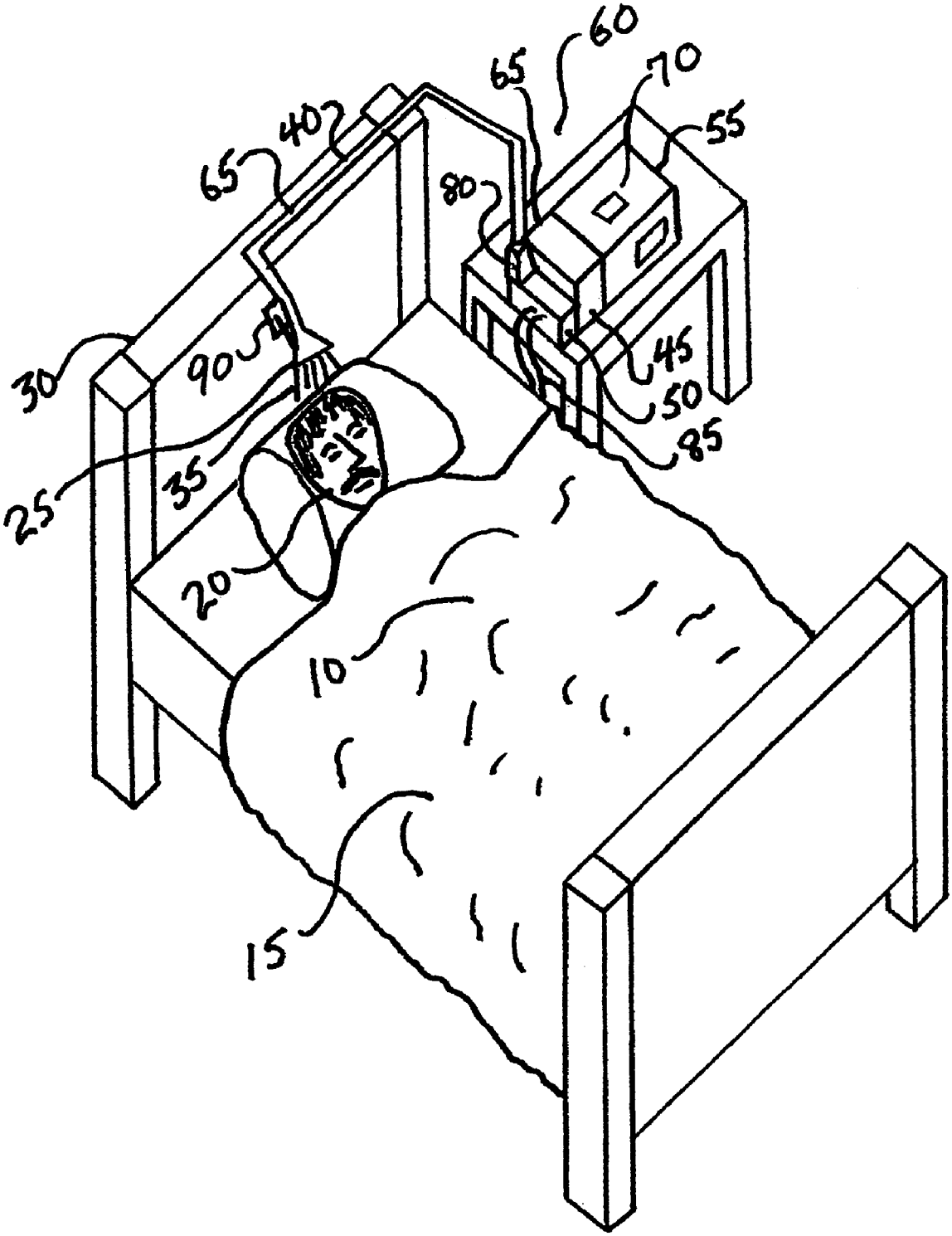
FIG. 1 is a top perspective oblique view of the invention showing the device oriented in relation to a sleeper.

10 Sleeper
15 Bed
20 Head of sleeper
25 Water outlet port
30 Headboard
35 Water
40 Main water conduit
45 Water reservoir
50 Pump
55 Timing device
60 Awakening device
65 Alarm portion
70 Deactivation switch
75 Poppet valve
80 Solenoid operated valve
85 Pressure sensing device
90 Bed head board attachment means
98 External water source
100 Gas cartridge

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 2:
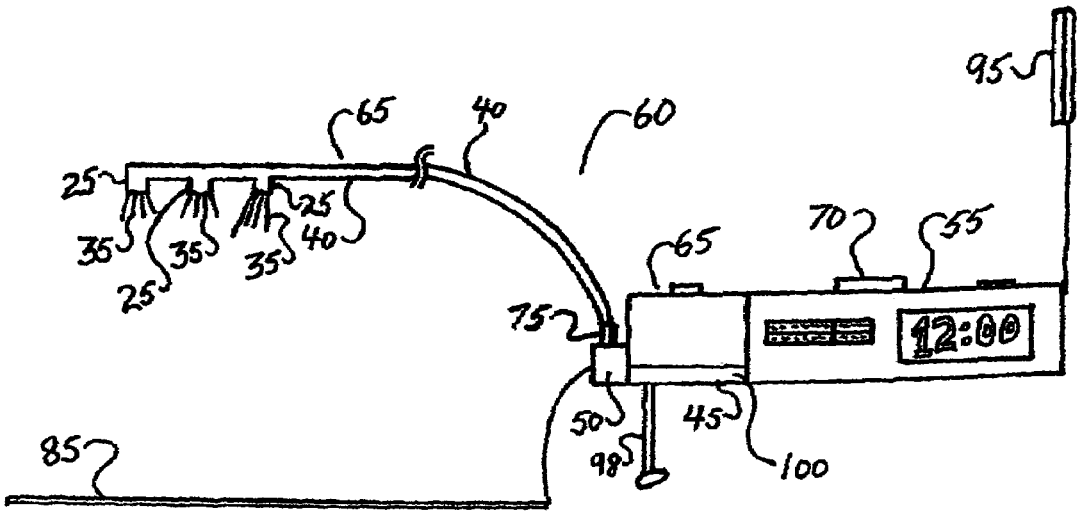
FIG. 2 is a front view of the invention showing the components of the invention.

Looking now at FIGS. 1 and 2, we see an awakening device (60) having an alarm portion (65) and a timing device (55) and we see a sleeper (10) (FIG. 1) in a bed (15). Positioned above the head (20) of the sleeper (10) we see a water outlet port (25) attached to the headboard (30) of the bed (15) by any means (90) well known in the art so that water (35) may be directed toward the head (20) of the sleeper (10) and thus serve as a stimulus which will cause the sleeper (10) to awaken. We understand that the water outlet port (25) may comprise a nozzle, an adjustable nozzle, or other adjustable water flow alteration means. Thus, we also understand that the alarm portion (65) of the device (60) comprises means to deliver a flow of water (35) and is activated by the timing device (55).

Looking again at FIGS. 1 and 2, we see that a main water conduit (40) communicates with the water outlet port (25) and a water reservoir (45) and we see that the water reservoir (45) may communicate with an external water source (98) (FIG. 2) not intrinsic to the device (60). In addition, we see a pump (50) to apply force to the water (35) to move it from the reservoir (45) to the water outlet port (25). In addition, we see a timing device (55), for example an alarm clock, well known in the art, which may be disposed to activate the pump (50) at a predetermined time for a predetermined length of time and/or intermittently at predetermined intervals and predetermined lengths of time after the initial activation of the pump (50). Furthermore, we understand that should the bed (15) (FIG. 1) contain a plurality of sleepers (10) or if the sleeper (10) should be prone to movement during sleep so that his position at any given time is not predictable, a plurality of water outlet ports (25) (FIG. 2) may be provided with the outlet ports (25) in parallel relationship to the main water conduit (40). Also, we understand that the water outlet port or ports (25) need not be attached to the headboard (30) but may be attached to other parts of the bed (15), a wall, other furniture, or customized support, or may not be attached to anything.

Looking again at FIGS. 1 and 2, we see that the device (60) may further comprise a pressure sensor or other device (85) capable of detecting the presence of a sleeper (10) (FIG. 1) in the bed (15). In addition, we understand that the sleeper detecting device (85) may be interfaced with the alarm portion (65) to prevent the alarm portion (65) from activating the water (35) flow if no one is in the bed.

In order to use the device, an incipient sleeper sets the timer (55) to activate the device (60) at the time he/she wishes to awaken, gets into the bed (15), and goes to sleep with head (20) proximate a water outlet port (25). At the proper time, the timer (55) activates the device (60) and the sleeper (10) is doused with an awakening quantity of water (35) of substantial density and force. Thus the awakening of the sleeper is affected by stimulation of his/her tactile senses and/or his/her ability to sense heat or cold so that we can readily appreciate that the device would be beneficial for use by the hearing impaired. The water (35) may flow for a preset time or it may flow until the awakened sleeper deactivates the device as he/she would an ordinary alarm clock, the operating principles of which are generally known.

Turning now to FIG. 2, we see the awakening device (60) comprising an alarm portion (65) and a timing portion (55). Also, we see that the timing portion (55) is an alarm clock of a type having generally well known features. In addition we understand that the alarm portion (60) is interfaced with the timing portion (55) so that electronic signals from the timing portion (55) will cause activation of the alarm portion at appropriate times. Furthermore, we see that the timing portion (55) may have a deactivation switch (70), but we understand that the deactivation switch (70) may just as well be comprised by the alarm portion (65).

Looking again at FIG. 1 and FIG. 2, we see the water reservoir (45) communicating with a pump (50) and a main water conduit (40) so that upon the activating signal from the timing portion (55) the pump may cause water (35) to move from the reservoir (45) through the main water conduit (40) and out through the water outlet port (25).

We understand that the alarm portion (65) may not be pressurized until engagement of the pump so that the flow of water through the main water conduit (40) will initially be small and as the pump (50) fully pressurizes, full flow will be reached over the period of time from initial pump activation to achievement of full pressure. However we understand that if full flow through the main water conduit (40) is desired initially, that there are many means, well known in the art of water delivery systems, to achieve such an end.

For example, a poppet valve (75) (FIG. 2) may be placed between the water reservoir (45) and the water outlet port (25). Or, the alarm portion (65) may be under constant pressure and a valve actuated by solenoid (80) (FIG. 1) may be placed between the reservoir (35) and the water outlet port (25). Furthermore, we understand that there are many different types of pumps (50) well known in the art that could be suitable for use in the alarm portion (65), and we understand further that there are alternatives to pumps (50) that could be used to provide force to move the water (35) from the reservoir (45) out through the water outlet port (25), a pressurized gas cartridge (100) (FIG. 2), for example.

In addition, we understand that the alarm portion of the device (65) may interface with devices other than timers or alarm clocks such as smoke alarms, burglar alarms, carbon monoxide alarms, or any other devices (95) (FIG. 2) designed to detect and issue an alarm upon detection of any particular substance or condition. Furthermore, we appreciate that the alarm portion of the device (65) may interface with devices (95) (FIG. 2) that do not necessarily detect emergency or calamitous conditions but that detect things such as the ringing of phones, the expiration of time on cooking appliance timers, or other events, the knowledge of which would be of benefit to the hearing impaired.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Machine for waking a sleeper comprising:
a water source;
means of propelling the water;
one or more water line(s);
one or more water outlet port(s); and
one or more timer and/or activation device(s).

2. A machine as in claim 1 wherein one or more water outlet ports comprise flow-rate adjustable nozzles.

3. A machine as in claim 1 wherein the timer and/or activation device detects physical changes in the environment.

4. A machine as in claim 1 comprising means to detect the presence of a sleeper.

5. A machine as in claim 1 wherein the water source is a reservoir intrinsic to the machine.

6. A machine as in claim 1 wherein the water source is an external water delivery system not intrinsic to the machine.

7. A machine as in claim 1 wherein at least part of the water propelling means is a pump.

8. A machine as in claim 1 wherein at least part of the means of propelling the water is pressurized fluid or gas.

9. A machine as in claim 1 comprising one or more valves in line with the water source and water outlet port.

10. A machine as in claim 1 comprising one or more solenoids controlling one or more valves between the water source and the water outlet port.

* * * * *